US005299978A

United States Patent [19]

Dennis et al.

[11] Patent Number: 5,299,978

[45] Date of Patent: Apr. 5, 1994

[54] AIR SWEEP MECHANISM

[75] Inventors: Richard D. Dennis, Bridgeport; Jon D. Rittle, Baldwinsville, both of N.Y.

[73] Assignee: Carrier Corporation, Syracuse, N.Y.

[21] Appl. No.: 878,068

[22] Filed: May 4, 1992

[51] Int. Cl.[5] ..... F24F 13/14

[52] U.S. Cl. ..... 454/285

[58] Field of Search ..... 454/153, 285, 313, 319, 454/320

[56] References Cited

U.S. PATENT DOCUMENTS 4,653,384 3/1987 Amano ..... 454/319

FOREIGN PATENT DOCUMENTS 173718 7/1988 Japan ..... 454/153

*Primary Examiner*—Harold Joyce

[57] ABSTRACT

A drive motor is located with its axis symmetrically between the parallel shafts on which a pair of louvers are rotatable mounted. A crank pin driven by the motor is connected to the two louver blades by drive arms attached to the upstream ends of the louver blades. A complete rotation of the motor shaft results in the louvers being relatively moved to sweep the air from an upward to a downward direction, while, at times, pinching the air to increase the throw thereof.

4 Claims, 2 Drawing Sheets

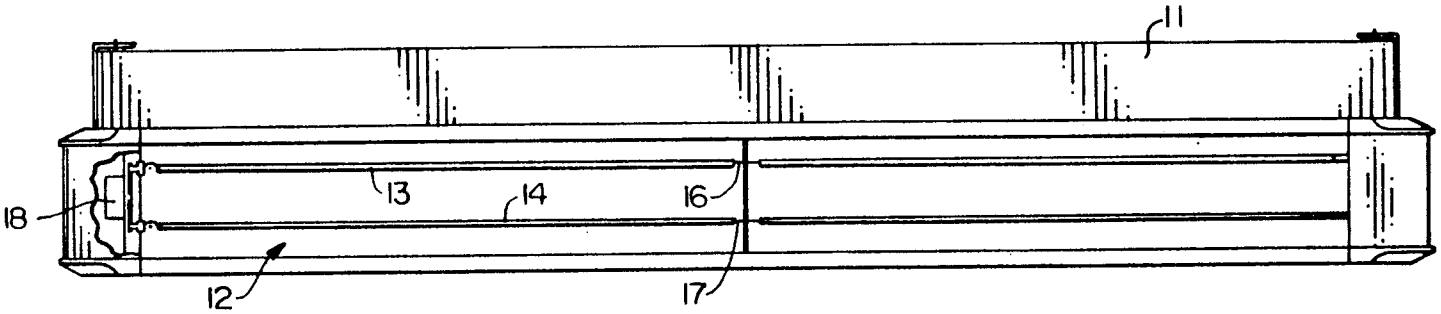
FIG.1
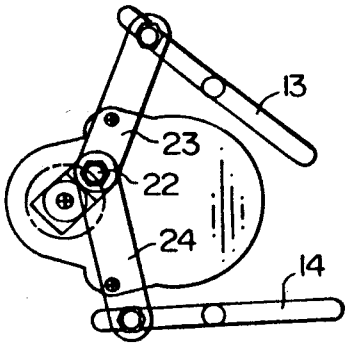
FIG.6
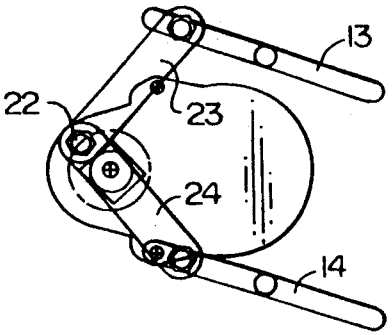
FIG.7
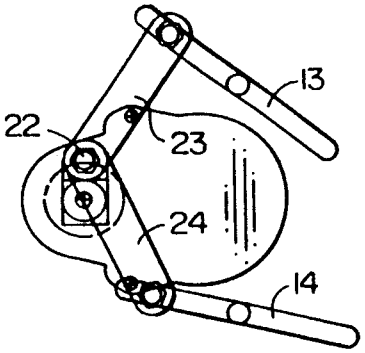
FIG.8
FIG.9

AIR SWEEP MECHANISM

BACKGROUND OF THE INVENTION

This invention relates generally to air conditioning systems and, more particularly, to a motor driven louver mechanism for sweeping the conditioned air emanating therefrom.

In an air conditioning system having an indoor unit that discharges the conditioned air directly from the unit to the space to be cooled, it has become common practice to provide a plurality of movable louvers in the discharge opening such that the direction of airflow can be controlled as desired. In order to enhance the air distribution performance of the unit, it has also become common to provide an "air sweep" mechanism, which causes the louvers to be continuously oscillated back and forth to "sweep" the airflow stream between the extreme points from side to side or from top to bottom. Such an apparatus is shown and described in U.S. Pat. No. 4,777,870 issued on Oct. 18, 1988 to the assignee of the present invention. It should be noted that, while such an apparatus provides for a relatively even distribution of conditioned air over a relatively large area, the louvers do little, if any towards the enhancement of the "throw" since they remain in parallel relationship at all times.

In order to increase the "throw" of a unit, louver movement mechanisms have been devised so as to orient adjacent louvers into non-parallel positions such that the air is "pinched" in such a manner as to increase the velocity of the air flowing therebetween and to thereby increase the "throw". One such mechanism is shown in U.S. Pat. No. 4,653,384. While this design does provide for a desirable increased throw capability, there are certain features of the design which are undesirable. For example, the drive linkage and motor arrangement is relatively remote from the two louvers such that the use of space is excessive and the driving force is transmitted over a greater distance than is necessary. Further, while the use of a slotted link does allow a variable pitch of the one louver, it also sacrifices positive control of that louver and may result in its movement in a manner not desired. For example, if the shaft is too tight within the slot, it may hang up in the slot and not allow the proper movement within the slot, and if it is too loose, as may result from wear which will naturally occur from the movement within the slot, then the linkage may become sloppy. But in any case, during the time when the shaft is between the two extremes within the slot, there is no control of the louver. Finally, it would appear that in order to obtain the dispersion that is desired, the louvers are necessarily angled at such extremes that the flow is considerably restricted so as to result in a lower volume of air flowing therethrough.

It is therefore an object of the present invention to provide an improved air sweep mechanism for an air conditioning system.

Another object of the present invention is the provision for the economical use of space in an air sweep mechanism.

Yet another object of the present invention is a provision in an air sweep mechanism for positive control of louver element positioning.

Still another object of the present invention is the provision in an air sweep mechanism for effectively dispersing conditioned air without significantly reducing the flow volume thereof.

Yet another object of the present invention is the provision for an air sweep mechanism which is economical to manufacture and effective in use.

These objects and other features and advantages become more readily apparent upon reference to the following description when taken into conjunction with the appended drawings.

SUMMARY OF THE INVENTION

Briefly, in accordance with one aspect of the invention, a drive motor is located with its axis being symmetrically located between and parallel to, the shafts on which a pair of louvers are rotatable mounted. A crank pin is attached to the motor shaft and revolves around its axis. Drivingly connected to the crank pin is a pair of drive arms, with each connected at its other end to one end of one of the louvers. As the crank is rotated by the motor, the drive arms act to pivot the respective louvers to various positions to thereby selectively disperse the air passing therebetween in an efficient and controlled manner without significant restrictions in airflow volume.

In the drawings hereinafter described, a preferred embodiment is depicted; however, various other modifications and all other constructions can be made thereto without departing from the true spirit and scope of the invention.

BRIEF DESCRIPTION OF THE DRAWINGS

FIG. 1 is an indoor unit with the present invention incorporated therein.

FIGS. 2 through 9 show the present invention in various operational positions as the drive motor completes a full revolution.

DESCRIPTION OF THE PREFERRED EMBODIMENT

Referring now to FIG. 1, there is shown an indoor unit at 11 having a heat exchanger coil (not shown) through which return air is caused to flow in heat exchange relationship therewith, to cool the air which is then caused by the fan to flow out a discharge opening 12 into the space to be cooled. Located in the discharge opening 12 are upper and lower louver blades 13 and 14, mounted on parallel shafts 16 and 17, in a rotatable manner. The shafts 16 and 17 are preferably located at the mid point (see FIG. 2) of the louvers 13 and 14, respectively. The purpose of the louver blades 13 and 14 is to direct the flow of cooled air from the discharge opening 12 into the room. This is accomplished by the motor drive and linkage mechanism of the present invention.

Figure 2:
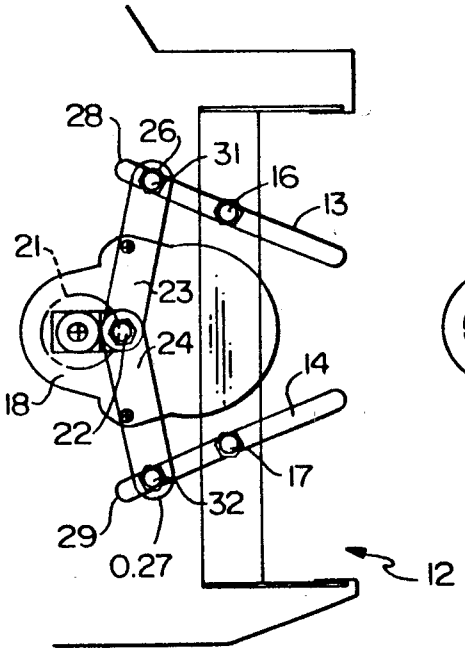

As will be seen in FIGS. 1 and 2, a drive motor 18 is located near one end of the louver blades 13 and 14, with its shaft 19 located symmetrically at a point between and parallel to the shafts 16 and 17. A drive motor that has ben suitable for this purpose is identified as model no. 417-616-21, which is commercially available from Eaton, Controls Division.

Drivingly connected to the drive shaft 19 is a crank arm 21 and a crank pin 22, with the crank pin 22 orbiting around the motor shaft 19. Drivingly connected to the crank pin 22 are a pair of drive arms 23 and 24, whose other ends 26 and 27, respectively, are connected near the respective upstream ends 28 and 29 of the louver blades 13 and 14 by pins 31 and 32. Rotation of the motor shaft 19, and the revolving of the crank pin 22 causes the drive arms 23 and 24 to pivot the louver blades 13 and 14 on their respective shafts 16 and 17 so as to vary the pitch thereof so as to effectively disperse the conditioned air passing between the louver blades 13 and 14. FIGS. 2–9 show the various positions of the louver blades 13 and 14 for various rotational positions of the crank pin 22 during one revolution of the motor shaft 19.

In FIG. 2, the crank pin 22 is in the zero degree position, i.e., at a point closest to and symmetrically between the two shafts 16 and 17. In this position, the louver blade 13 is angled downwardly and the louver blade 14 is angled upwardly so as to "pinch" the air passing therebetween, causing it to increase in velocity and thereby extend farther out into the space to be conditioned. In this position, the downward angle of louver blade 13 is equal to the upward angle of louver blade 14 such that the resultant direction of the airflow is generally in a horizontal plane.

Figure 3:
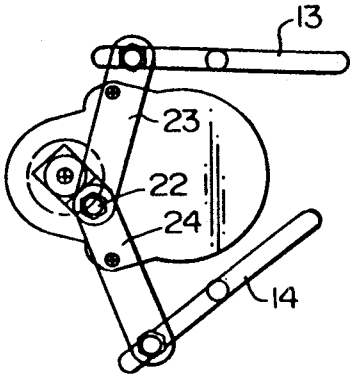

In FIG. 3, the crank pin 22 has rotated clockwise to the 45° position wherein the symmetrical relationship no longer holds and the upward angle of louver blade 14 is increased, with the downward angle of the louver blade 13 being decreased almost to zero. Here there is some, but less, pinching of the airflow stream, and the resultant airflow direction is in an upward direction from the horizontal plane.

Figure 4:
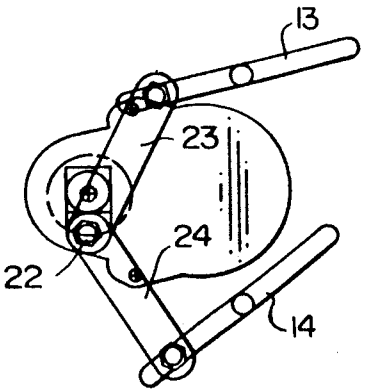

In FIG. 4, the crank pin 22 is rotated clockwise to the 90° position, with the louver blade 14 being in substantially the same upward angle, but with the louver blade 13 now being oriented in an upward, but smaller angle. Here again there is some pinching of the airflow stream, and the resultant thrust direction is at a greater upward angle from the horizontal plane. It is at this position that the resultant thrust direction of the airflow stream reaches its highest upward angle.

Figure 5:
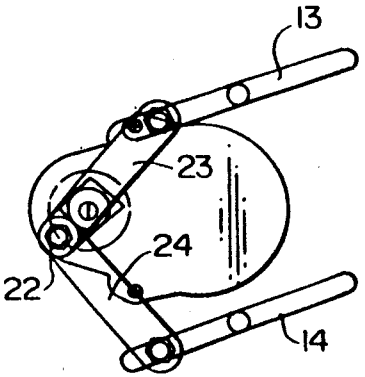

Referring now to FIG. 5, the crank pin 22 has rotated to the 135° position, with the louver blades 13 and 14 both being oriented at an upward angle which is equal for both blades such that they are now parallel. Here, there is no pinching of the airflow stream, and the resultant direction has moved downwardly from the FIG. 4 position.

In FIG. 6, the crank pin 22 has moved to a 180° position, farthest from, and symmetrically between the shafts 16 and 17. Now the louver blade 13 is oriented at a slightly upward angle and the louver blade 14 is oriented at a slightly downward angle such that the resultant airflow stream is in the horizontal direction with a small amount of upward and downward dispersion. Here the effective blockage or resistant to the airflow stream is at a minimum, and the airflow volume will therefore be at a maximum.

In FIG. 7, the crank pin 22 has moved to the 225° position such that the louver blades 13 and 14 are parallel with equal downward angles. Here, the resultant thrust of the air stream is slightly in the downward direction, and the resistant to flow is very small, thereby resulting in a very high volume flow of air.

In FIG. 8, the crank pin 22 has moved to its most upward position of 270°, with the louver blade 14 being at about the same downward angle as in the FIG. 7 position, but with the louver blade 13 being at a greater downward angle. Here, the resultant direction of the airflow stream is at the most downward angle, and there is some pinching of the airflow stream to increase the "throw".

In FIG. 9, the crank pin has moved to the 315° degree position, with the louver blade 13 being in substantially the same downward angle but with the louver blade 14 coming up to almost the horizontal position. The resultant thrust direction is slightly upward from the FIG. 8 position, but the pinching effect is increased to thereby further increase the "throw".

Finally, the crank pin 22 again moves to the 0° position as shown in FIG. 2 to complete the cycle.

It will thus be seen that with a full revolution of the crank pin 22, the first three representative positions (i.e., 0°–90°) the louver blades 13 and 14 are generally in the pinching orientation with the airflow direction being generally in the horizontal and then in the upward direction. In the next three representative positions (i.e., 135°–225°) the louver blades are in the non-pinching orientation, with the airflow direction moving from upward, to a horizontal, and then to a downward direction. In the last 90° rotation, the louver blades again are in a pinching orientation, with the direction going from a downward direction to a generally horizontal direction. It should be noted that in none of these positions, are the louver blades 13 oriented in such a manner so as to substantially block the flow of air to thereby reduce the volume flow therethrough. Further, positive positional control of each of the louver blades is maintained at all times.

Although present invention has been disclosed with particular reference to a preferred embodiment, the concepts of this invention are readily adaptable to other embodiments, and those skilled in the art may vary the structure thereof without departing from the essential spirit of the invention.

What is claimed is:

1. An improved air sweep mechanism of the type having a pair of adjacent louver blades mounted on parallel shafts in a rotatable manner to allow the blade angles to be varied to thereby change the direction of air flowing between the blades, wherein the improvement comprises:

a drive motor disposed near the louver blades for driving a crank pin in an orbiting pattern around an axes; and a pair of drive arms rotatable attached to said crank pin at their one ends and each having its other end attached to a respective one of the louver blades at a point distal from the louver blade shaft;

whereby, during a complete orbit of said crank pin, the louver blade angles are respectively varied by the movement of said drive arms such that the blades jointly function to vary both the direction and the throw of the air flowing therebetween.

2. An improved air sweep mechanism as set forth in claim 1 wherein said drive arms are of substantially the same length.

3. An improved air sweep mechanism as set forth in claim 1 wherein said louver blade shafts are located substantially at the mid-point of said louver blades.

4. An improved air sweep mechanism as set forth in claim 1 wherein said crank pin axis is symmetrically located between said louver blade shafts.

* * * * *